US008823543B2

(12) United States Patent
Camwell et al.

(10) Patent No.: US 8,823,543 B2
(45) Date of Patent: Sep. 2, 2014

(54) TELEMETRY WAVE DETECTION APPARATUS AND METHOD

(75) Inventors: Paul L. Camwell, Calgary (CA); James M. Neff, Okotoks (CA); Douglas S. Drumheller, Cedar Crest, NM (US)

(73) Assignee: XACT Downhole Telemetry Inc., Calgary, Alberta (CA)

( * ) Notice: Subject to any disclaimer, the term of this patent is extended or adjusted under 35 U.S.C. 154(b) by 769 days.

(21) Appl. No.: 13/046,574

(22) Filed: Mar. 11, 2011

(65) Prior Publication Data

US 2011/0163889 A1 Jul. 7, 2011

Related U.S. Application Data

(62) Division of application No. 11/786,646, filed on Apr. 11, 2007, now Pat. No. 7,928,861.

(60) Provisional application No. 60/792,965, filed on Apr. 19, 2006.

(51) Int. Cl.
*G01V 3/00* (2006.01)

(52) U.S. Cl.
USPC ..... 340/856.3; 340/854.7; 73/504.01; 356/498; 702/159

(58) Field of Classification Search
CPC .... E21B 47/12; E21B 47/123; G01B 9/02019
USPC ..... 340/854.4, 856.3; 367/82–83; 73/504.12; 356/486, 498, 512, 5.09; 181/111; 702/64, 23, 159
See application file for complete search history.

(56) References Cited

U.S. PATENT DOCUMENTS

| | | | |
|---|---|---|---|
| 5,128,901 | A | 7/1992 | Drumheller |
| 5,260,762 | A | 11/1993 | Telle |
| 5,305,089 | A | 4/1994 | Hosoe |
| 5,477,505 | A | 12/1995 | Drumheller |
| 5,489,984 | A | 2/1996 | Hariharan et al. |
| 6,943,894 | B2 | 9/2005 | Kitahara |
| 6,956,791 | B2 | 10/2005 | Dopf et al. |

(Continued)

OTHER PUBLICATIONS

Young, Warren C. and Richard G. Budynas, Roark's Formulas for Stress and Strain, p. 592, Section 13.8 Tables, Table 13.1, Case 1, 7th Edition.

(Continued)

*Primary Examiner* — Albert Wong
(74) *Attorney, Agent, or Firm* — Klarquist Sparkman, LLP

(57) ABSTRACT

Non-contacting means of measuring the material velocities of harmonic acoustic telemetry waves travelling along the wall of drillpipe, production tubing or coiled tubing are disclosed. Also disclosed are contacting means, enabling measurement of accelerations or material velocities associated with acoustic telemetry waves travelling along the wall of the tubing, utilizing as a detector either a wireless accelerometer system or an optical means, or both; these may also be applied to mud pulse telemetry, wherein the telemetry waves are carried via the drilling fluid, causing strain in the pipe wall that in turn causes wall deformation that can be directly or indirectly assessed by optical means.

The present invention enables detection of telemetry wave detection in space-constrained situations. The invention also teaches a substantially contactless method of determining the time-based changes of the propagating telemetry waves. A final benefit of the present invention is that it demonstrates a particularly simple contacting means of directly measuring wall movements in live coiled tubing drilling environments.

10 Claims, 7 Drawing Sheets

(56) References Cited

U.S. PATENT DOCUMENTS

| | | | | |
|---|---|---|---|---|
| 7,224,467 | B2 | 5/2007 | Tsai | |
| 7,424,928 | B2 * | 9/2008 | Cox et al. | 181/111 |
| 7,499,479 | B2 | 3/2009 | Nishimura | |
| 7,578,187 | B2 | 8/2009 | Takahashi et al. | |
| 7,649,631 | B2 | 1/2010 | Ueno | |
| 7,928,861 | B2 * | 4/2011 | Camwell et al. | 340/854.4 |
| 2007/0056794 | A1 * | 3/2007 | Cox et al. | 181/111 |
| 2007/0056795 | A1 * | 3/2007 | Cox et al. | 181/111 |
| 2010/0315248 | A1 * | 12/2010 | Townsend et al. | 340/635 |
| 2012/0072128 | A1 * | 3/2012 | Gao | 702/23 |
| 2012/0185192 | A1 * | 7/2012 | Townsend et al. | 702/64 |

OTHER PUBLICATIONS

Office Action from Canadian Intellectual Property Office, for Canadian Patent Application No. 2,584,841, dated Jul. 29, 2010.

Notice of Allowance from the United States Patent & Trademark Office in U.S. Appl. No. 11/786,646, dated Dec. 14, 2010.

* cited by examiner

TELEMETRY WAVE DETECTION APPARATUS AND METHOD

CROSS REFERENCE TO RELATED APPLICATIONS

The present application is a divisional of U.S. patent application Ser. No. 11/786,646, filed Apr. 11, 2007, now U.S. Pat. No. 7,928,861 which claims the benefit of U.S. Provisional Application No. 60/792,965, filed Apr. 19, 2006, both of which applications are incorporated herein by reference.

FIELD

The present invention relates to telemetry apparatus and methods of detection used in the oil and gas industry, and more particularly to methods of detecting telemetry waves propagating predominantly along or through coiled tubing or drillpipe or similar.

BACKGROUND

There are three major methods of wireless data transfer from downhole to surface (or vice versa) for oil and gas drilling in use today: mud pulse, electromagnetic and acoustic telemetry. In a typical acoustic telemetry drilling or production environment, acoustic waves are produced and travel predominantly along the metal wall of the tubing associated with the downhole section required to drill the well. The acoustic energy is usually detected by sensitive accelerometers, and sometimes by relatively less sensitive strain gauges. Care needs to be taken about the positioning and coupling of such devices to the tubing in order that the maximum signal energy can be extracted in order to optimize the detection system's signal to noise ratio (SNR). See U.S. Pat. Nos. 5,128,901 and 5,477,505 to Drumheller for a further discussion of this issue.

In the case of jointed pipe drilling, the surface detection system will be attached at some position below the traveling block (see FIG. 1), and despite such systems being relatively small (see, for example, U.S. Pat. No. 6,956,791 to Dopf et al.) can cause severe space constraint issues, particularly in the type of oil rigs that utilize top drive motors to turn the drillpipe. In the case of coiled tubing rigs, a similar space constraint arises (see FIG. 2) because there is normally very little space available to optimally attach the detection mechanism directly to the coiled tubing. Furthermore, the problem is compounded in the case of coiled tubing in that the coil—to which the accelerometer is beneficially attached—continually moves into or out of the well. The present invention addresses these constraints and seeks to provide novel means by which they may be overcome.

SUMMARY

It is an object of certain embodiments of the present invention to overcome non-optimal constraints of accelerometer positioning in the detection of telemetry waves that are utilized in transferring data from one part of the tubing between a surface drilling rig and the telemetry transmitter. The methods disclosed herein may be applied to mud pulse telemetry applications or acoustic telemetry applications.

Exemplary embodiments of the present invention provide a contact or a contactless system and method for detecting telemetry waves in any of production tubing, jointed drill pipe, coiled tubing drilling, or any downhole apparatus which transmits telemetry waves that cause measurable radial or axial motion of pipe or tubing of the apparatus (collectively "drillstring").

According to one aspect, there is provided an apparatus for detecting telemetry waves along a drillstring of a rig. The apparatus comprises: a first laser system in optical communication with a material that is moved by the passage of telemetry waves along the drillstring; and a second laser system in optical communication with a reference portion on or nearby a part of the rig which is not significantly moved by the passage of telemetry waves. The combined output of said first laser system and said second laser system provides a measure of the telemetry waves, which can be pressure pulse waves or acoustic waves.

The first laser system can be in optical communication with a fluid surrounding a portion of a drillstring through which telemetry waves pass; in such case the combined output of said first laser system and said second laser system provides a measure of an instantaneous velocity of a reflecting surface in association with said fluid; said instantaneous velocity providing an indicator of a volume change in said fluid in response to the telemetry waves. In this application, the drillstring can be tubing of a coiled tubing rig. The first laser system can also comprise a laser and a floating reflector in the fluid and the second laser system can comprise a laser and a reflector coupled to the reference portion. For example, the reflector can be coupled to a stripper of a coiled tubing rig.

Alternatively, the first laser system can be in optical communication with a portion of the drillstring through which telemetry waves pass, such as piping of a jointed pipe rig. The first laser system can comprise a laser and a collar having a reflective surface. The laser can be coupled to a travelling block of a jointed pipe rig, and the collar can be coupled to a swivel sub of the jointed pipe rig. The second laser system can comprise a laser and a reflector fixed at the reference portion. This laser is coupled to a travelling block of a jointed pipe rig, and the reflector is coupled to a non-rotating kelly spinner of the jointed pipe rig.

Optionally, the first or the second laser system or both are optically coupled to the respective material and reference portion by at least one minor.

According to another aspect, there is provided an apparatus for detecting a plurality of telemetry waves along a drillstring of a rig. The apparatus comprises: a wheel in non-slipping contact with a portion of the drillstring through which telemetry waves pass; and measurement means such as an accelerometer in communication with the wheel and for measuring a characteristic of the wheel's rotation. Axial movement of the drillstring caused at least in part by telemetry waves passing therethrough rotates the wheel.

At least one wheel can be resiliently coupled to a stripper of a coiled tubing rig.

Alternatively, the measurement means can be an or an optical detector. In a first case, the optical detector can be a laser vibrometry system comprising at least one reflector mounted on the wheel and a laser in optical communication with the reflector. In such case, the optical detector can further comprise a beam-bending optical cell optically coupling the laser with the reflector. In a second case, the optical detector can be a differential laser vibrometry system comprising a first laser system in optical communication with the wheel and a second laser in optical communication with a reference portion of a part of the rig through which telemetry waves do not pass.

According to another aspect, there is provided an apparatus for detecting a plurality of telemetry waves along a drillstring of a rig. This apparatus comprises: contact means for contacting a portion of the drillstring through which telemetry waves pass; and measurement means in communication with the contact means such that radial motion of the drillstring portion is measured, wherein the radial movement of the drillstring is caused at least in part by telemetry waves passing therethrough.

The contact means can be a wheel resiliently coupled by an arm to a portion of the drill string through which telemetry waves do not pass. The measurement means can be an optical detector, such as a differential laser vibrometry system comprising a first laser system in optical communication with the arm and a second laser in optical communication with a reference portion of a part of the rig through which telemetry waves do not pass.

An object of certain embodiments of the present invention is to detect the material velocity (or similar parameter) of particles that are caused to move by the passage of an acoustic telemetry wave travelling along the drillpipe or tubing. For example, travelling harmonic acoustic waves propagate in passbands along drillpipe, and the specifics of these passbands are determined by the type of wave and the geometry of the drillpipe (see, for example, U.S. Pat. No. 5,477,505 to Drumheller). Extensional waves will be discussed herein, although it will be readily apparent to one skilled in the art that the present invention applies also to different types of waves (e.g. rotational waves) and different types of pipe (e.g. production tubing). The discussion begins by considering the mechanical plastic deformation of a steel tube as an extensional wave travels along, and this is then used to assess the required sensitivity of the detection means. As a starting point, a reasonable assumption is made that typical modern accelerometers are able to detect power levels (W) down to the one μW level, so the contactless detection means should be at least compatible with this value.

Consider:

$$W=z\,V_a^2 \quad [1]$$

where z=tubing impedance and $V_a$=axial material velocity due to the passage of a simple harmonic wave, and $$z=\rho Ac \quad [2]$$

where ρ=tubing density, A=tubing wall area, c=bar sound speed in steel.

Inserting typical values for steel coiled tubing, thus:

ρ=7800 kg/m$^3$, tubing outer diameter (OD)=3", tubing inner diameter (ID)=2.75", c=5130 m/sec Combining equations 1 and 2 leads to $V_a$=5.9 μm/sec.

This axial material velocity causes a change in the tubing OD as predicted by Poisson's ratio, as follows.

Consider that for a simple wave the relation between axial strain $C_a$ and material axial velocity $V_a$ is:

$$\epsilon_a=V_a/c \quad [3]$$

Poisson's ratio μ is:

$$\mu=-\epsilon_r/\epsilon_a \quad [4]$$

where $\epsilon_a$ is the radial strain.

The change in the outer radius of the tubing due to axial strain is:

$$\Delta r=r\epsilon_r \quad [5]$$

where r=radius of the tubing.

The radial velocity $V_r$ varies according to the frequency f of the propagating axial wave, and using equations 3, 4 and 5 produces:

$$V_r=2\pi f\Delta r=2\pi f\mu V_a/c \quad [6]$$

A suitable frequency value for an extensional wave in coiled tubing is 2500 Hz, thus:

$$V_r=0.2\ \mu\text{m/sec}$$

Thus if one detects the axial changes in material velocity in the outer wall of typical coiled tubing (with the parameters as given above) due to axial wave propagation one must have a device that has sensitivity of better than 5.9 μm/sec. If instead one is constrained to detect the radial changes primarily caused by the plastic deformation in the outer wall of typical coiled tubing due to the change in material axial motion one must have a device that has sensitivity of better than 0.2 μm/sec.

Published values for laser Doppler vibrometer sensitivity (see Polytec Inc., 'Vibrometry Basics'—'HSV-2000 High Speed Vibrometer') are typically 1 μm/sec. Therefore it is reasonable to utilize such devices for the axial detection of acoustic waves, but further enhancement is required to detect radial acoustic waves.

Furthermore, the possible application also extends to mud pulse telemetry. This is because in such telemetry systems the downhole mud pulser creates a pressure wave that travels substantially to the surface through the drilling fluid in the pipe or tubing, creating a stress wave in the walls of the pipe or tubing as it propagates. The stress wave travels along with the pressure pulse and the deformation of the walls can be assessed by means explained as follows. It is well known (see, for instance, *Rourke's Formulas for Stress and Strain, 6$^{th}$* Edition, pub. McGraw Hill) that for relatively thin-walled tube such as drilipipe or coiled tubing, the incremental change in radius is given by:

$$\Delta r=r^2\Delta P/Et \quad [7]$$

where E=Young's modulus and t=wall thickness.

Inserting r=3 inches, t=0.25 inches, ΔP=100 psi, E=30×10$^6$ (steel) we find that Δr=3 μm.

Typical pulse amplitudes detected at surface are ~100 psi. Considering that normally these mud pulses are usually generated in 0.1 seconds, last for 0.5 to 1.5 seconds, and decay in 0.1 seconds, a laser vibrometer would need to detect a radial increase of 3 μm at a velocity of ~30 μm/second, a stationary period lasting ~1 second and a radial decrease of 3 μm at a velocity of ~30 μm/second. As noted before, this range of measurement is well within the capabilities of modern differential laser vibrometers. The optical output would then be converted and filtered by conventional digital signal process techniques to provide a data stream pertinent to the data inherent in the timing of the mud pulses.

It is to be noted that one can also consider the usefulness of this method, not only for surface detection but downhole for range extension (repeater) purposes.

This summary of the invention does not necessarily describe all features of the invention. Other aspects and features of the present invention will become apparent to those of ordinary skill in the art upon review of the following description of specific embodiments of the invention.

BRIEF DESCRIPTION OF THE DRAWINGS

The following drawings illustrate the principles of the present invention and exemplary embodiments thereof.

DETAILED DESCRIPTION

Figure 1:
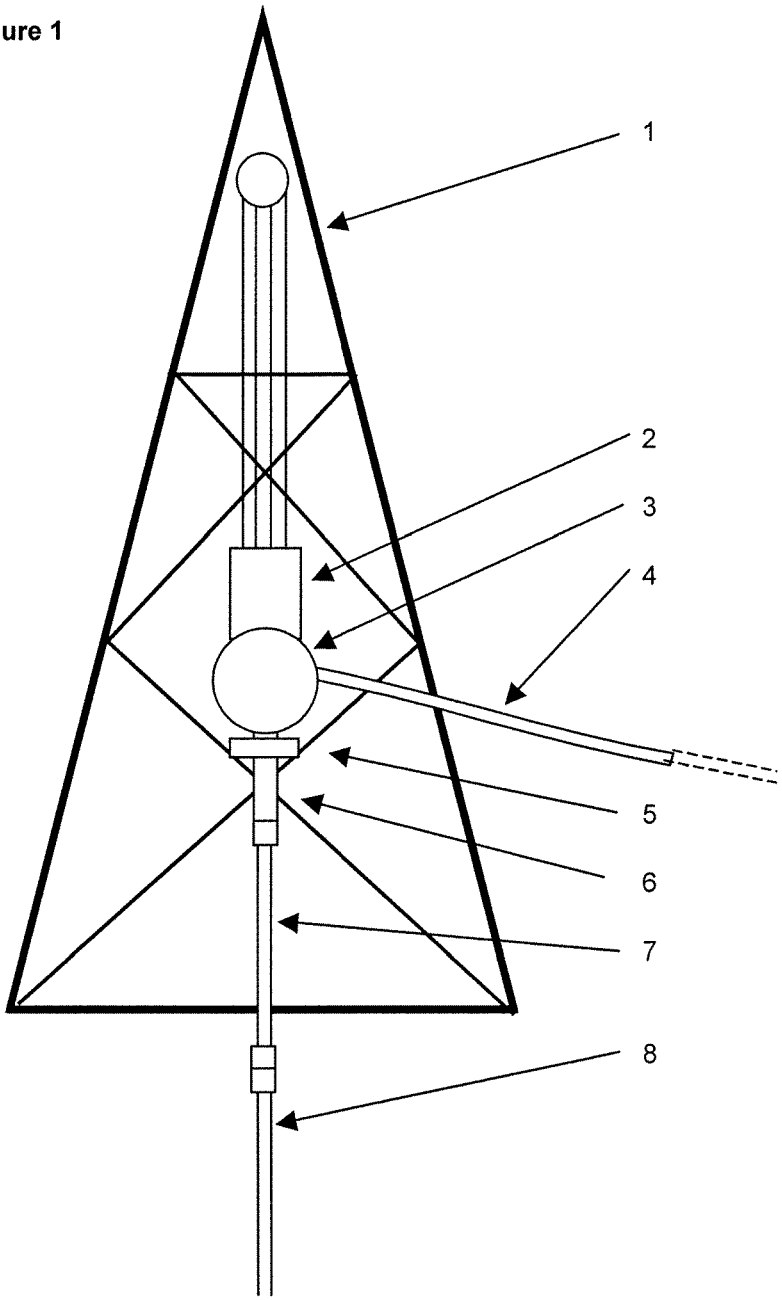
PRIOR ART Figure 1
FIG. 1 is a very simplified representation of a jointed drill pipe rig, with many of the relevant pipe handling components indicated, with the intent of showing the available positions for an acoustic wave detector.

FIG. 1 illustrates a typical first type of drillstring, namely a jointed pipe rig 1. A supported traveling block 2 supported by cables is attached to a kelly swivel 3. The swivel's function is to take in the drilling fluid via the kelly hose 4 while also supporting a rotating structure called a kelly spinner 5 that in turn supports a pipe 6 (the 'quill' in a top drive rig, the 'swivel sub' in a jointed pipe rig) to which a kelly pipe 7 is screwed. This assembly enables the pipes from the kelly top on down to rotate according to the drilling needs while being connected to other non-rotating devices and structures above. The rotation means in this figure would be implemented by a rotating section of the rig floor (the 'rotary table') through which the kelly is constrained to pass and rotate. Other rigs may utilize a motor called a top drive unit. These devices are mentioned briefly here for completeness, but as they have minor relevance to the invention will not be further detailed.

Acoustic waves transmitted from downhole propagate up through the drillpipe 8, kelly and swivel sub before encountering a major acoustic mismatch formed by the significant dimensional change at the kelly spinner/swivel interface. The junction effectively faints a non-rigid boundary that significantly reflects the acoustic wave. To those skilled in the art it is apparent that this is an optimum position for an axial accelerometer to be placed in order to detect the acoustic waves. In many embodiments the accelerometer is part of a wireless detection system (see, for example, U.S. Pat. No. 6,956,791 to Dopf et al.).

In normal drilling procedures the swivel sub, the kelly and the attached drillpipe will rotate at typically 1 to 3 times per second. The kelly is moved vertically from its full height above the rig floor (~10 m) to being almost level with the floor. This brings the aforementioned wireless detection system close to the rig crew who are working next to the tubing on the rig floor. Thus it is necessary for safety reasons that such detection means are minimally sized and have virtually no projections. This space and safety issue is heightened on rigs using top drive units because there is much less space to attach the wireless detection system. It is evident that a significant improvement would be achieved if the detection means comprised an optical contactless system.

Figure 2:
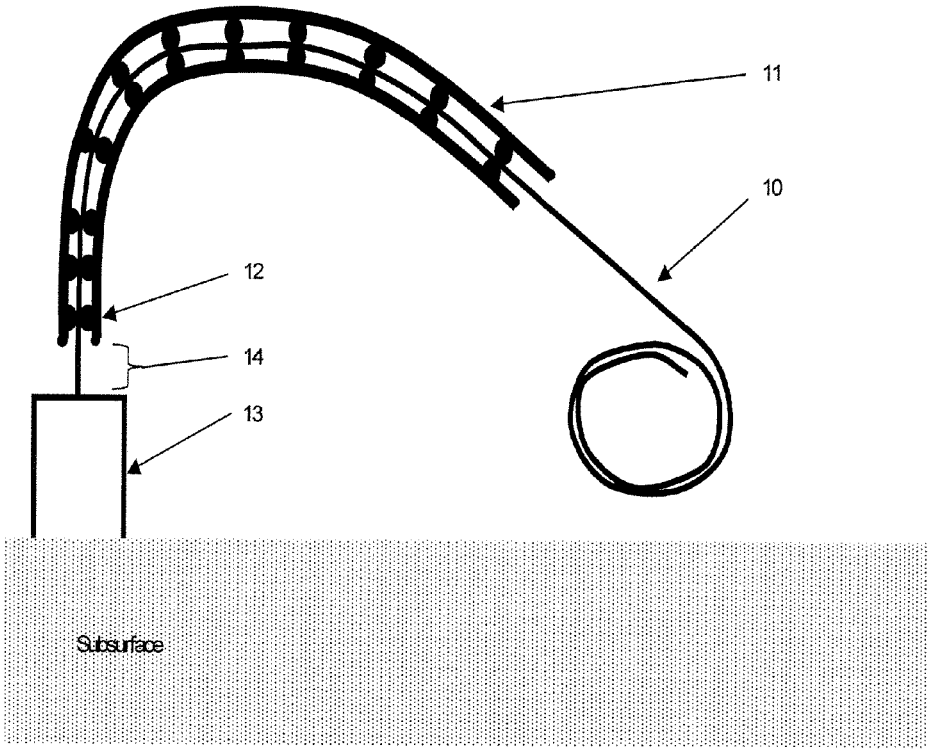
PRIOR ART Figure 2
FIG. 2 is a similar representation of a coiled tubing rig, again with the intent of showing the available position for an acoustic wave detector.

FIG. 2 is a very simplified view of the components of a second type of drill string, namely a coiled tubing rig. A coil of tubing 10 is led through a conveyancing means (injector) 11. The tubing exits the injector head 12 just prior to moving down a structure called a 'stripper' 13. The gap 14 between the injector head and the stripper is typically 18 to 24 inches long; it is apparent that this is a suitable place at which to detect the axial acoustic telemetry waves. Unfortunately this gap is often surrounded by other critical components associated with drilling requirements, and thus it is necessary that whatever detectors are used do not interfere with tubing movement nor with adjacent mechanical structures. The present invention helps address these severe size constraints.

Figure 3:
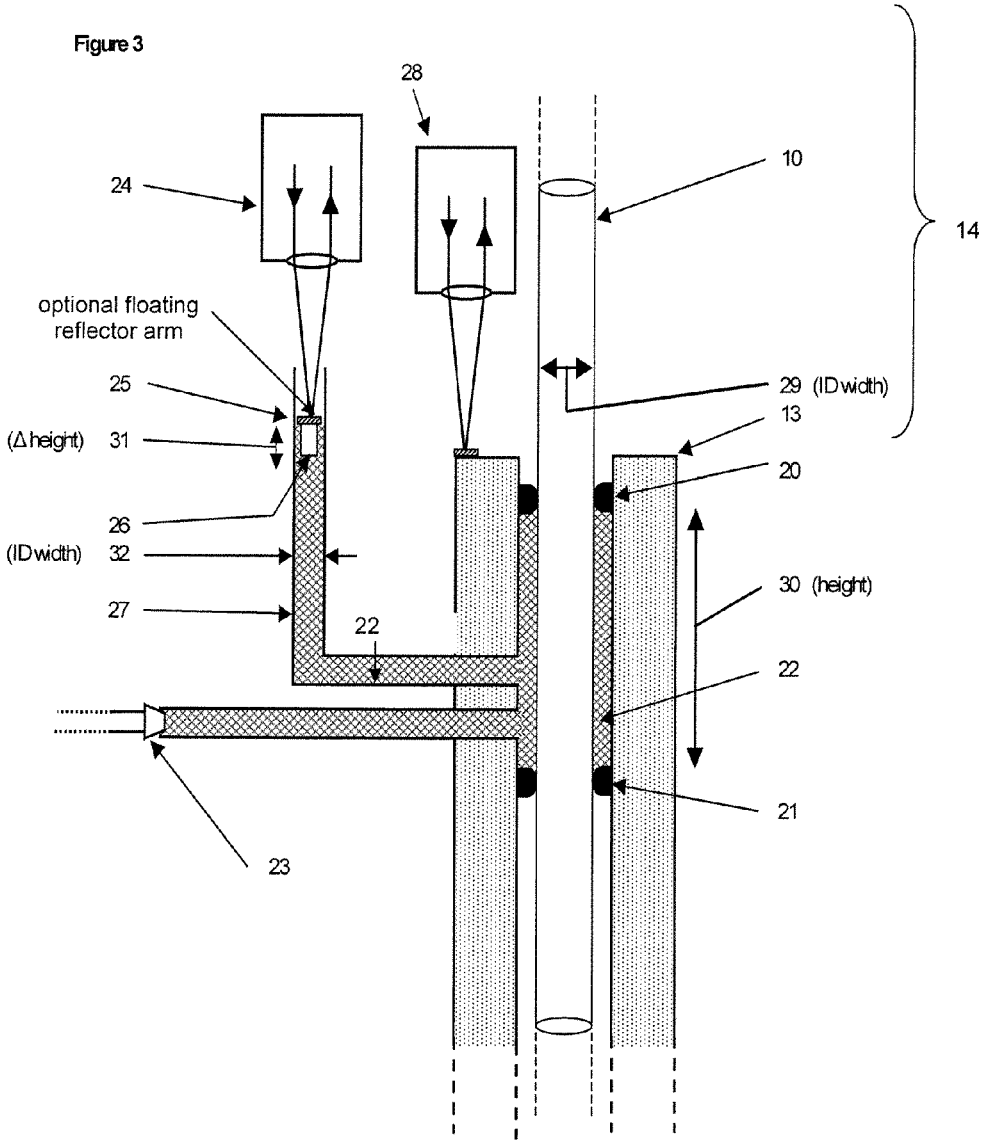
FIG. 3 shows how the dimensional changes to a section of coiled tubing can be hydraulically amplified so as to change the position of a reflector that is being monitored by a differential optical system.

FIG. 3 shows a section of coiled tubing 10 within a stripper 13. The stripper's primary purpose is to contain the wellbore fluids and/or pressure. Specifically, the circumferential seals prevent fluids or gasses from venting to atmosphere. In the exemplary embodiment two such seals 20, 21 are illustrated whose additional purpose is to constrain a fluid 22 such as water or oil in the annular space between the coiled tubing and the upper portion of the stripper. This fluid is kept at a reasonably constant volume by a filler port 23. The height of the fluid is determined by a laser system 24 (laser 1) that measures height by reflecting off a surface (diffuse or mirror) 25 from a float 26 in the reflector arm 27.

It is not necessary to incorporate a floating reflector in the reflector arm. For instance, laser 1 can be configured to reflect from the top of the column of fluid (the meniscus) as long as the laser beam's incident/reflecting angles are adequate and there is sufficient difference in the refractive index between the monitoring fluid and the fluid or gas above; this could be accomplished by using oil as the monitoring fluid and air as the material above.

Laser 1 is part of a laser Doppler vibrometer system (see, for instance, 'Principle of Laser Doppler Vibrometry' at Polytek.com for a basic explanation) in the illustrated embodiment. Laser 2 28 is employed to implement a differential measurement such that the combined output of laser 1 and laser 2 is a sensitive measure of the instantaneous velocity of the reflecting surface (mirror or diffuse).

While two lasers 24, 28 are used in this embodiment to implement a differential method, it is evident to one skilled in the art that a single laser split into two beams can serve the same purpose.

As already noted, the reflecting surface motion includes the transformed axial velocity of the pipe wall due to the passage of an acoustic wave. The inherent axial motion conversion to radial motion via Poisson's ratio is used to move the surface of the fluid in the reflector arm. The motion is further amplified by the ratio of the volume of fluid surrounding the pipe to the volume of fluid in the reflector arm, as follows:

The change in the annular volume ΔV of the fluid between the two circumferential seals, the ID of the stripper and the OD of the tubing caused by the tubing's radial increase in diameter from D 29 to D+ΔD is given to an adequate approximation (ignoring quadratic terms) by $$\Delta V=\pi HD\Delta D/2 \quad [8]$$

where H 30 is the distance between the seals.

This volume change is transferred to the reflector arm as manifested by a change in the height of the column of fluid, given by 31:

$$\Delta h=4\,\Delta V/\pi d^2 \quad [9]$$

where d is the diameter 32 of the reflector arm.

Thus by combining equations 8 and 9 the hydraulic gain $G_h$ is shown to be $$G_h=\Delta h/\Delta D=2H\,D/\Delta d^2 \quad [10]$$

As shown above, if the vibrometer system is capable of measuring an axial velocity $V_a$ of ~6 m/sec, and the radial velocity $V_r$ is below its sensitivity, an hydraulic gain of ~(6/0.2)=30 is required. If in a particular embodiment H=3", D=3" we find that we require Δd to be approximately 0.63". Reducing Δd further will increase the gain, enabling a smaller $V_r$ to be measured, but at the cost of increasing noise.

It will be obvious that there will be other significant changes in fluid volume surrounding the pipe, caused, for instance, by pipe non-uniformity along its length, pipe dimensional changes due to changes in internal drilling fluid pressure, temperature, and so on. These changes can be largely offset by monitoring the level of the reflector via the laser system (using a known ranging technique) and compensating with fluid changes via the filler port. Implementation of a suitable level feedback technique will now be readily apparent to one skilled in the art.

The particular advantage of utilizing a laser measurement system, specifically in a mode that provides an output proportional to the target velocity, is that it becomes a simple matter to filter out extraneous motions. In the exemplary embodiment discount gross motions would be discounted due to bulk fluid level changes, retaining only the relatively high frequency velocities associated with the passing of the acoustic wave. This has the effect of significantly increasing the acoustic telemetry detector's SNR, enabling the detection and decoding of data impressed on the acoustic wave.

There are further advantages of using optical measurement systems—for instance, there is no need to be in contact with the actual pipe/stripper assembly. This enables the possibly bulky optical devices to be remote from the small space available around the exposed pipe, and to maintain appropriate monitoring of the reflector arm fluid sensor (laser 1) and also the stripper positioning for differential detection (laser 2) via the judicious use of mirrors.

Figure 4A:
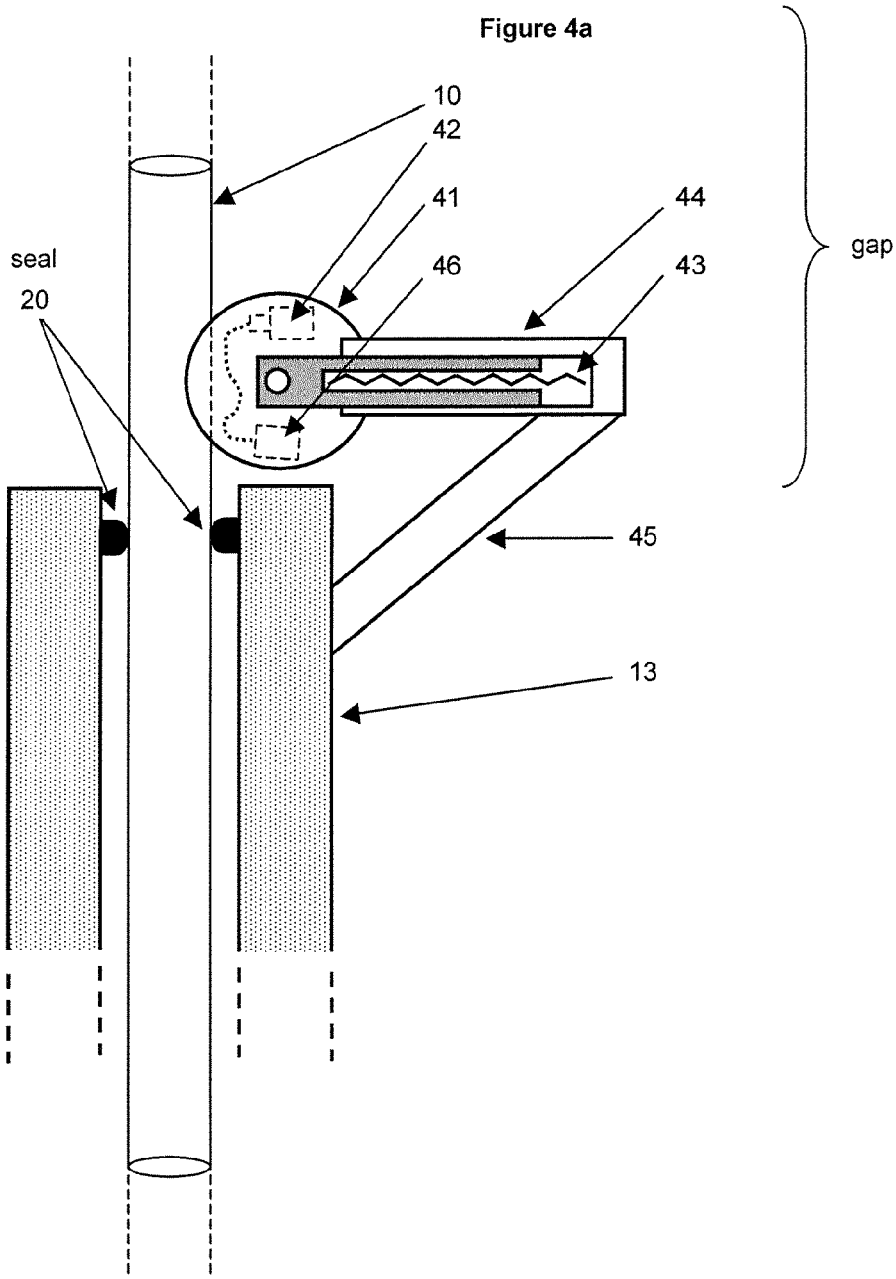
FIG. 4*a* indicates how an accelerometer can be mounted such that it is able to monitor axial extensional acoustic waves travelling along moving coiled tubing while it remains in essentially the same position.

FIG. 4*a* illustrates how a relatively small wheel 41 can be utilized to extract axial extensional acoustic wave motion from a section of coiled tubing 10. As indicated in FIG. 2, there is normally only a small section 14 of exposed tubing available from which to attach a detector such as an accelerometer. The injector 11 that forces the coiled tubing 10 into the stripper 13 forms a mechanically stiff system that does not allow a significant propagation of such waves past the injector head 12. Measurements show that the mechanical barrier formed by the injector head 12 acts as a rigid boundary. The boundary causes the majority of the upward travelling waves to reflect at this point and travel back toward the source. It is obvious to those skilled in the art that an appropriate place to detect such waves would be to place the accelerometer at a distance of λ/4 down from the head, where λ, is the wavelength. This distance in practical terms is approximated by utilizing the harmonic frequency (2,500 Hz) and the bar speed (5,130 m/s) to suggest that 0.51 m (~20") would be appropriate. The available exposed section 14 in most coiled tubing rigs is compatible with this value. It has been ascertained that even in situations where there is not enough room for a 20" exposure, modifications to the stripper can make available adequate room for the detector described herein. The usual attachment means in the industry are to directly connect an accelerometer oriented axially to the tubing. Because the tubing is in most circumstances either moving into or out of the stripper 13 this approach is generally unworkable. According to the present invention, by contrast, the accelerometer 42 is attached to the side of a simple wheel 41 that is held in non-slipping contact with the pipe via a spring-loaded 43 arm 44 that is attached to some convenient location 45, such as the top of the stripper. Despite the rotation of the wheel altering the orientation of the accelerometer, as long as the accelerometer is tangentially attached to the wheel the axial motions within the pipe will be faithfully reproduced by the wheel's motion. Indeed, one could even consider a multiple wheel gearing mechanism by which to magnify the rotation of the accelerometer with respect to the axial motions of the pipe. There now remains the problem of sampling the electrical output of the accelerometer while it is rotating. This is readily accomplished—for instance, one could use slip rings to make appropriate sliding contacts, or one could use a wireless (RF) link 46. The wheel can be any stiff material with dimensions that provide low inertia (such as aluminium), as long as it does not slip and does not significantly change the impedance of the tubing at the point of contact.

Figure 4B:
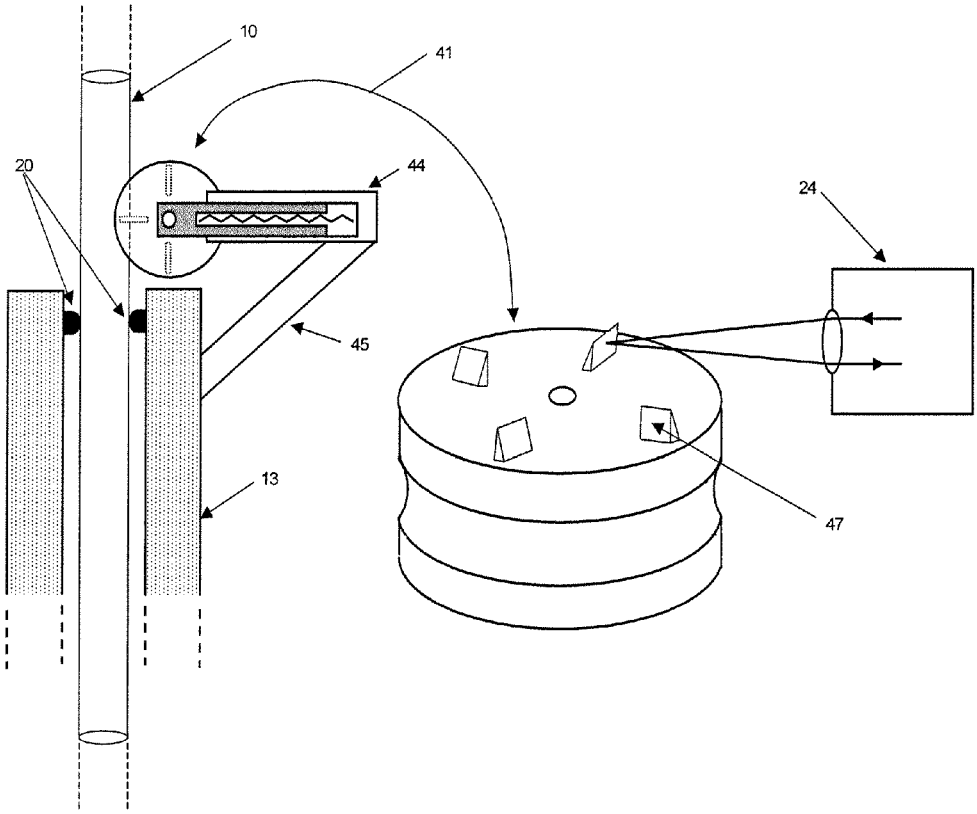
FIG. 4*b* indicates how a contactless optical means, such as a laser vibrometry system can assess the axial material velocity of the tubing by replacing the accelerometer of FIG. 4*a* with a series of reflectors disposed along the outside of a wheel that rotates as the tubing moves.

FIG. 4*b* represents a modification of the non-slipping wheel 41 as depicted in FIG. 4*a*, but with the accelerometer 42 and RF link 46 replaced by optical means. This has the benefit that in extreme cases where space around the stripper 13 is very limited it is helpful to measure the angular motion of the wheel 41 by a laser vibrometry system (or similar) 24. In this case it is illustrated how a set of four paddles 47 can be attached to one side of the wheel and used as retroreflectors for the optical system. As the wheel turns it will be obvious that the paddles change angle; thus a mirror surface could be beneficially replaced by corner cube or spherical retroreflective material (such as one of the Scotchlite™ products). For clarity only four such paddles are illustrated, but as would be apparent to one skilled in the art, not only do the paddles change angle but also change vertical and horizontal positions as the rotation proceeds, and this effect can be accommodated by attaching more such paddles. As one paddle moves out of optical range another will move in. During the transition one could interpose a beam-bending optical cell between laser system 24 and the wheel 41, and it is also apparent that a differential laser vibrometry system would be beneficial, as indicated in FIG. 3, as would be readily evident to one skilled in the art.

Figure 4C:
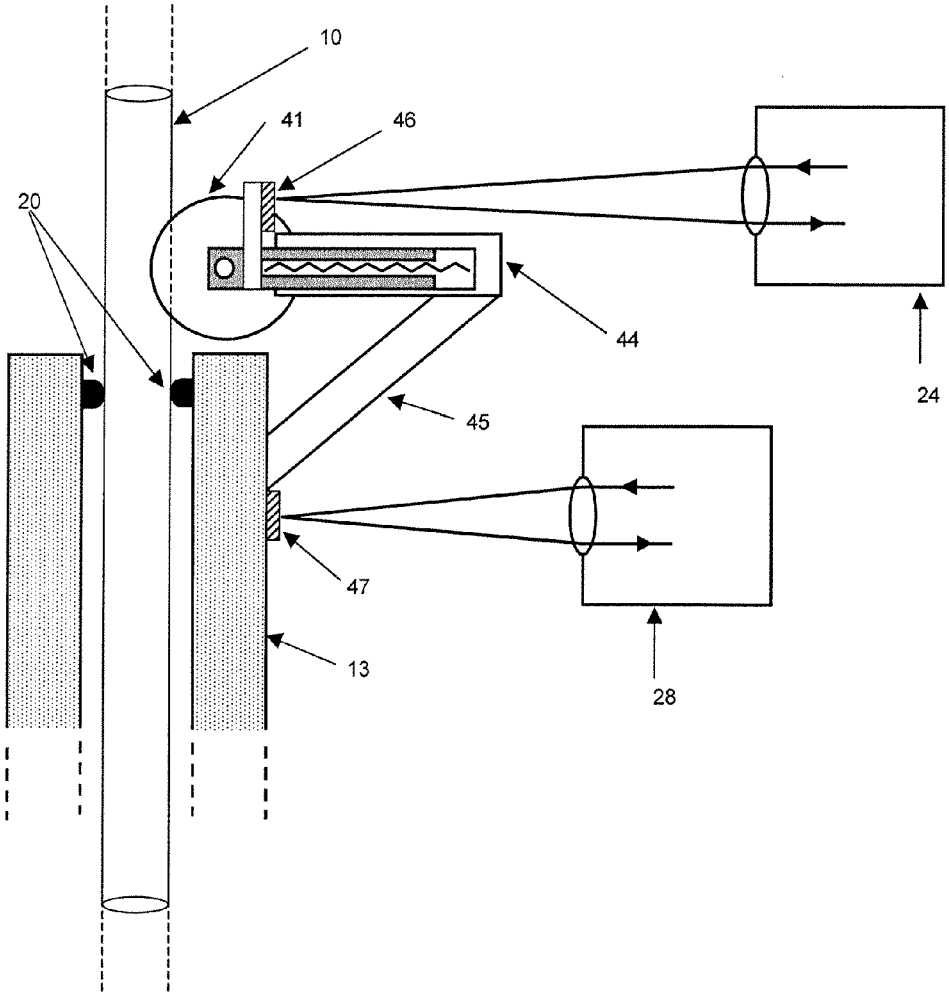
FIG. 4*c* indicates how a contactless optical means, such as a laser vibrometry system, can assess the radial material velocity of the pipe or tubing by replacing the accelerometer of FIG. 4*a* with a reflector or retroreflector disposed on the arm holding a contacting wheel against the pipe or tubing that rotates as the tubing or pipe moves.

FIG. 4*c* illustrates an exemplary embodiment which omits both jacket and accelerometer sensors. This embodiment is relevant to mud pulse telemetry in that optical means are employed to determine the pipe or tubing wall 10 movement associated with the strain imparted to the wall as a result of a propagating downhole pressure pulse. It also shows further optical means laser 1 24 and laser 2 28 that may be used to enhance accuracy via differential detection, whereby laser 1 detects motion of the section of the spring-loaded 44 that follows the radial motion of the wheel 41 that is pressed against the pipe or tubing. The principle illustrated by this embodiment is that a travelling pressure wave generated by a downhole mud pulse telemetry system produces stress waves in the wall of the pipe or tubing containing the pulser. These stress waves plastically defoim the pipe, the defoimations manifesting as pipe wall movement coincident with the passage of the pressure wave. Modern laser vibrometers are capable of detecting such changing movements and thus the pipe or tubing via motion of a reflector or retroreflector 46, in a differential mode using a reflector or retroreflector 47 thereby and achieving a viable telemetry sensor alternative to accelerometers.

It will be obvious to one skilled in the art that this method readily extends to jointed pipe rigs.

Figure 5:
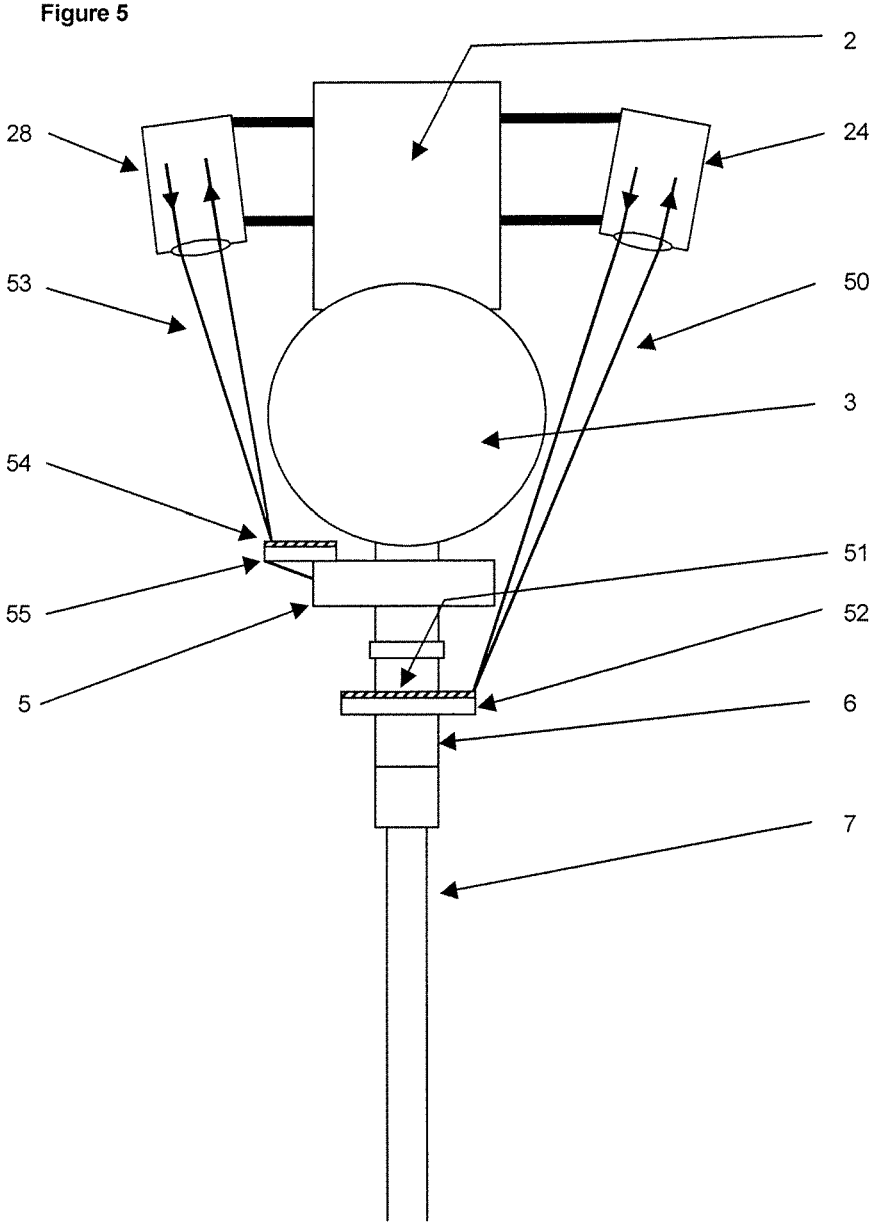
FIG. 5 shows how the concepts established in the previous figures can be implemented on a jointed pipe rig such that axial material velocity can be measured via a contactless optical means, such as a laser vibrometry system, by using a reflector mounted on a suitable position on the swivel sub.

FIG. 5 shows an embodiment applicable to the setting of FIG. 1, wherein a laser vibrometer system is implemented with the purpose of contactlessly and differentially monitoring the axial material motion of the acoustic telemetry waves. The travelling block 2 supports a primary laser system (laser 1) 24 that emits and receives laser beams 50 that are aimed at a retroreflecting surface 51 supported by a collar 52 attached to the swivel sub 6. In this circumstance the laser systems can be safely located well out of the way of the rig crew.

The collar 52 would be placed at an appropriate position on the swivel sub so as to optimally detect the harmonic acoustic telemetry waves, such that reflections at the kelly spinner would not deleteriously affect the combined acoustic signal and reduce its amplitude via destructive interference. The advantage of the collar is not only that it can conveniently be placed at an optimally-receiving position but that it is passive and can be made small and unobtrusive, hardly interfering with normal rig operation. The same can be said for the other retroflector 54 in its role as a differential means.

As the swivel sub and kelly 7 rotate the retroreflecting material will contain at least two axial motions—that due to the material motion in the pipe wall caused by the passage of an acoustic telemetry wave, and that due to minor wobbles of the pipe as it rotates. As previously noted, it is a relatively straightforward matter to filter the latter from the former and improve the SNR. Improvements in the determination of the axial movement due to the acoustic waves are afforded by incorporating a differential measurement, which is implemented by a reference laser vibrometer system 28 (laser 2) that is also attached to the travelling block 2. This system emits and receives laser beams 53 that are targeted to a relatively stationary retroreflector 54 supported on a block 55 that is firmly attached to the non-rotating kelly spinner 5. As would be appreciated by those skilled in the art, rig motion determined by laser 2 is subtracted from rig motion plus acoustic wave motion determined by laser 1, thus leading to an improved SNR associated with the movement due solely to the acoustic wave travelling along the drillpipe, the kelly and finally the swivel sub.

It is also evident that the laser systems could be located quite independently of the travelling block and associated machinery. Indeed, they could be attached to the rig floor or superstructure and the laser beams 50 and 53 could be aimed as appropriate via mirrors.

Furthermore, it will now be evident that the laser systems could also assess the material movements of two retroreflecting surfaces (as 51). The usefulness in this case is that it is possible to separate the two surfaces in order that the relative phase difference between them due to their separation while being moved by the passage of an acoustic wave would enable subsequent discrimination of upward-travelling waves and downward-travelling waves (i.e. detection via a phased detector array).

Furthermore, it will now be obvious that the optical system, though preferably stationary, need not be so. It could be attached to surface rotating members (generally tubulars) such as the swivel sub. The information gathered could then be recorded or wirelessly retransmitted, or even transferred via slip rings.

It will be apparent that the embodiment shown in FIG. 5 can be adapted to detect pressure waves as produced by mud pulse telemetry. While the embodiments described herein are primarily for acoustic wave telemetry embodiment (extensional waves that travel primarily in the wall of the drillpipe), it will be straightforward to one skilled in the art from such a description to provide embodiments for detecting pressure waves that travel primarily along the drilling fluid constrained by the drillpipe, particularly as the radial extension of the pipe due to the passage of a travelling pressure pulse also creates an axial pipe extension (Poisson effect) that can be similarly monitored by a laser vibrometer system.

One or more currently preferred embodiments have been described by way of example. It will be apparent to persons skilled in the art that a number of variations and modifications can be made without departing from the scope of the invention as defined in the claims.

We claim:

1. An apparatus for detecting a plurality of telemetry waves along a drillstring of a rig, the apparatus comprising:

a wheel in non-slipping contact with a portion of the drillstring through which telemetry waves pass; and measurement means in communication with the wheel and for measuring a characteristic of the wheel's rotation, wherein axial movement of the drillstring caused at least in part by telemetry waves passing therethrough rotates the wheel.

2. An apparatus as claimed in claim 1 wherein said at least one wheel is resiliently coupled to a stripper of a coiled tubing rig.

3. An apparatus as claimed in claim 1 wherein the measurement means is an accelerometer.

4. An apparatus as claimed in claim 1 wherein measurement means is an optical detector.

5. An apparatus as claimed in claim 4 wherein the optical detector is a laser vibrometry system comprising at least one reflector mounted on the wheel and a laser in optical communication with the reflector.

6. An apparatus as claimed in claim 5 wherein the optical detector further comprises a beam-bending optical cell optically coupling the laser with the reflector.

7. An apparatus as claimed in claim 4 wherein the optical detector is a differential laser vibrometry system comprising a first laser system in optical communication with the wheel and a second laser in optical communication with a reference portion of a part of the rig through which telemetry waves do not pass.

8. An apparatus for detecting a plurality of telemetry waves along a drillstring of a rig, the apparatus comprising:

a wheel for contacting a portion of the drillstring through which telemetry waves pass, the wheel being resiliently coupled by an arm to a portion of the drill string through which telemetry waves do not pass; and measurement means in communication with the wheel such that radial motion of the drillstring portion is measured, wherein the radial movement of the drillstring is caused at least in part by telemetry waves passing therethrough.

9. An apparatus as claimed in claim 8 wherein the measurement means is an optical detector.

10. An apparatus as claimed in claim 9 wherein the optical detector is a differential laser vibrometry system comprising a first laser system in optical communication with the arm and a second laser in optical communication with a reference portion of a part of the rig through which telemetry waves do not pass.

* * * * *